US009331398B2

(12) United States Patent
Jiang

(10) Patent No.: US 9,331,398 B2
(45) Date of Patent: May 3, 2016

(54) DUAL-MODE TERMINAL ANTENNA AND SIGNAL PROCESSING METHOD

(75) Inventor: Hui Jiang, Shenzhen (CN)

(73) Assignee: ZTE CORPORATION, Shenzhen, Guangdong (CN)

( * ) Notice: Subject to any disclaimer, the term of this patent is extended or adjusted under 35 U.S.C. 154(b) by 538 days.

(21) Appl. No.: 13/258,336

(22) PCT Filed: May 7, 2010

(86) PCT No.: PCT/CN2010/072538

§ 371 (c)(1),
(2), (4) Date: May 15, 2012

(87) PCT Pub. No.: WO2010/148793

PCT Pub. Date: Dec. 29, 2010

(65) Prior Publication Data

US 2012/0218166 A1 Aug. 30, 2012

(30) Foreign Application Priority Data

Nov. 20, 2009 (CN) ..... 2009 1 0221570

(51) Int. Cl.
*H01Q 5/00* (2015.01)
*H01Q 25/04* (2006.01)
(Continued)

(52) U.S. Cl.
CPC ..... *H01Q 25/04* (2013.01); *H01Q 5/307* (2015.01); *H01Q 5/314* (2015.01)

(58) Field of Classification Search
CPC ..... H01Q 1/22; H01Q 1/2258; H01Q 1/2266; H01Q 1/2275; H01Q 1/24; H01Q 1/241; H01Q 1/242; H01Q 1/243; H01Q 5/00; H01Q 5/0003; H01Q 5/001; H01Q 5/0024; H01Q 5/0031; H01Q 5/0044; H01Q 5/0048; H01Q 5/0093
USPC ..... 343/702, 853, 858, 860, 893, 816, 820, 343/822
See application file for complete search history.

(56) References Cited

U.S. PATENT DOCUMENTS 4,141,016 A * 2/1979 Nelson ..... 343/858
6,985,760 B2 * 1/2006 Hosonuma ..... 455/575.3
(Continued)

FOREIGN PATENT DOCUMENTS

CN 1423368 A 6/2003
CN 1816941 A 8/2006
(Continued)

OTHER PUBLICATIONS

International Search Report in international application No. PCT/CN2010/072538, mailed on Aug. 26, 2010.
(Continued)

*Primary Examiner* — Sue A Purvis
*Assistant Examiner* — Patrick Holecek
(74) *Attorney, Agent, or Firm* — Oppedahl Patent Law Firm LLC

(57) ABSTRACT

The disclosure discloses a dual-mode terminal antenna, comprising a main antenna comprising a main antenna of a first mode and a main antenna of a second mode, an auxiliary antenna comprising an auxiliary antenna of the first mode and an auxiliary antenna of the second mode, and an antenna bracket. The main and auxiliary antennas are fixed on a same antenna bracket, each of which is configured with a spring lea. When the antenna bracket is clasped on a main board, four spring leaves of the main and auxiliary antennas contact with four antenna feeding points on the main board respectively, An LC resonant circuit is disposed ahead of each antenna feeding point, and four LC resonant circuits resonate at a working frequency band of the antenna corresponding to the antenna feeding point with which each said LC resonant circuits connects, respectively. The disclosure also discloses a signal processing method, which solves signal interference and loss problems existed in an antenna of the prior art in a reception mode, through high impedance of the LC resonant circuit to the signal at different frequency bands. Furthermore, the dual-mode terminal antenna of the disclosure simplifies the layout of the Printed Circuit Board (PCB).

15 Claims, 3 Drawing Sheets

(51) Int. Cl.
*H01Q 5/307* (2015.01)
*H01Q 5/314* (2015.01)

(56) References Cited

U.S. PATENT DOCUMENTS

| | | | | |
|---|---|---|---|---|
| 7,082,322 | B2 * | 7/2006 | Harano | 455/575.1 |
| 7,405,697 | B2 * | 7/2008 | Ying | 343/700 MS |
| 7,548,208 | B2 | 6/2009 | Dou et al. | |
| 2006/0220959 | A1 | 10/2006 | Ying | |
| 2007/0200773 | A1 | 8/2007 | Dou et al. | |
| 2009/0224984 | A1 | 9/2009 | Nysen et al. | |
| 2009/0295651 | A1 | 12/2009 | Dou et al. | |
| 2011/0102290 | A1 * | 5/2011 | Milosavljevic | 343/852 |

FOREIGN PATENT DOCUMENTS

| | | | |
|---|---|---|---|
| CN | 201018004 | Y | 2/2008 |
| CN | 201063361 | Y | 5/2008 |
| CN | 201114118 | Y | 9/2008 |
| CN | 101702470 | A | 5/2010 |
| EP | 2109230 | A1 | 10/2009 |
| JP | 2002280862 | A | 9/2002 |
| WO | 2009036352 | A1 | 3/2009 |

OTHER PUBLICATIONS

English Translation of the Written Opinion of the International Search Authority in international application No. PCT/CN2010/072538, mailed on Aug. 26, 2010.

* cited by examiner

DUAL-MODE TERMINAL ANTENNA AND SIGNAL PROCESSING METHOD

TECHNICAL FIELD

The disclosure relates to the field of antenna designing for a mobile terminal, in particular to a dual-mode terminal antenna supporting Worldwide Interoperability for Microwave Access (WIMAX) and a signal processing method.

BACKGROUND

As wireless technology develops increasingly and laptop computer popularizes progressively, it becomes more and more popular to access the Internet by using a laptop computer. The WIMAX is a new Third Generation (3G) mobile communication standard, and as there are some problems with network coverage of current WIMAX, in order to meet user's requirement of accessing the Internet anytime and anywhere, it is quite necessary to use the dual-mode terminal adopting the WIMAX and another mode, for example, the dual-mode terminal with the WIMAX and an Evolution Data Only (EVDO) modes. The full name of the EVDO is CDMA2000 1xEV-DO, which is a stage of CDMA2000 1x evolution.

In the dual-mode terminal with the WIMAX and another mode, a diversity function is added in order to improve signal quality, that is, the antenna includes a main antenna and an auxiliary antenna of the WIMAX, and a main antenna and an auxiliary antenna of another mode. The main antenna of the WIMAX and that of another mode are generally called main antennas, and the auxiliary antenna of the WIMAX and that of another mode are generally called auxiliary antennas. The main antennas are responsible for signal emission and signal reception, and the auxiliary antennas serve as reception diversity. In the present situation that space of the antenna reserved in a terminal product becomes smaller and smaller, how to dispose the antenna reasonably, to make the antenna meet layout requirement of the Printed Circuit Board (PCB), structure requirement and antenna performance index requirement, has became an urgent issue.

FIG. 1 shows an antenna structure of an existing dual-mode terminal. The antenna structure has two antenna brackets, wherein the antenna bracket 1 is used for fixing the main antennas including the main antenna of the WIMAX and that of another mode; and the antenna bracket 2 is used for fixing the auxiliary antennas including the auxiliary antenna of the WIMAX and that of another mode. The main antenna of the WIMAX operates at an emission frequency band and a reception frequency band of the WIMAX, and the main antenna of another mode operates at the emission frequency band and the reception frequency band corresponding to the another mode, for example, the main antenna of the EVDO operates at the emission frequency band and reception frequency band of the EVDO. The auxiliary antenna of the WIMAX operates at a reception diversity frequency band of the WIMAX, and the auxiliary antenna of the another mode operates at the reception diversity frequency band corresponding to the another mode for example, the auxiliary antenna of the EVDO operates at the reception diversity frequency band of the EVDO.

With the development of the terminal product, requirement for an area of the PCB occupied by the antenna becomes more and more strict, that is, it is required that the area of the PCB occupied by the antenna should be as small as possible, but an existing antenna structure cannot meet such requirement well. Besides, an existing antenna in a reception mode has serious signal interference and loss problems.

SUMMARY

In view of the above, the main purpose of the disclosure is to provide a dual-mode terminal antenna supporting the WIMAX and a signal processing method, to simplify the layout of the PCB and to solve the signal interference and loss problems existed in an existing antenna in a reception mode.

In order to achieve the purpose, the technical solution of the disclosure is realized as follows.

The disclosure provides a dual-mode terminal antenna, which includes a main antenna consisting of a main antenna of a first mode and a main antenna of a second mode, and an auxiliary antenna consisting of an auxiliary antenna of the first mode and an auxiliary antenna of the second mode, wherein the dual-mode terminal antenna may further include an antenna bracket, wherein the main antenna and the auxiliary antenna are fixed on a same said antenna bracket, and the main antenna of the first mode, the auxiliary antenna of the first mode, the main antenna of the second mode, the auxiliary antenna of the second mode are each configured with a spring leaf;

wherein when the antenna bracket is clasped on a main board, four spring leaves of the main antenna and the auxiliary antenna contact with four antenna feeding points on the main board respectively; and wherein an LC resonant circuit is disposed ahead of each said antenna feeding points, and four said LC resonant circuits resonate at a working frequency band of the antenna corresponding to the antenna feeding point with which each said LC resonant circuits connects, respectively.

The antenna bracket may be a right-angle bracket.

The antenna bracket may have a main antenna area and an auxiliary antenna area, which are used for fixing the main antenna and the auxiliary antenna respectively.

The main antenna of the first mode may operate at an emission frequency band and a reception frequency band of the first mode, the auxiliary antenna of the first mode may operate at a reception diversity frequency band of the first mode, the main antenna of the second mode may operate at the emission frequency band and the reception frequency band of the second mode, and the auxiliary antenna of the second mode may operate at the reception diversity frequency band of the second mode.

The first mode may be the Worldwide Interoperability for Microwave Access (WIMAX) and the second mode may be the Evolution Data Only (EVDO).

The disclosure also provides a signal processing method, which may include:

a LC resonant circuit disposed ahead of each antenna feeding points of a dual-mode terminal antenna resonates at a working frequency band of the antenna corresponding to the antenna feeding point with which each said LC resonant circuits connects, respectively;

when the dual-mode terminal antenna receives a signal of a first mode, the LC resonant circuit disposed ahead of the antenna feeding point of a second mode, creates high impendence to the signal of the first mode; and when the dual-mode terminal antenna receives a signal of a second mode, the LC resonant circuit disposed ahead of the antenna feeding point of the first mode creates high impendence to the signal of the second mode.

The method may further include: the dual-mode terminal antenna receives the signal of the first mode via the main and auxiliary antennas of the first mode, and receives the signal of the second mode via the main and the auxiliary antennas of the second mode.

The method may further include: the main antenna of the first mode operates at an emission frequency band and a reception frequency band of the first mode, the auxiliary antenna of the first mode operates at a reception diversity frequency band of the first mode, the main antenna of the second mode operates at the emission frequency band and the reception frequency band of the second mode, and the auxiliary antenna of the second mode operates at the reception diversity frequency band of the second mode.

The first mode may be a WIMAX and the second mode may be an EVDO.

The dual-mode terminal antenna supporting the WIMAX provided by the disclosure, which is configured with the main antenna and the auxiliary antenna on a same antenna bracket and ensures that the main antennas operates at the emission frequency bands and the reception frequency bands of the WIMAX and the another mode and the auxiliary antennas operates at reception diversity frequency bands of the WIMAX and the another mode, simplifies a PCB layout, sufficiently utilizes the PCB space, reduces the cost and facilitates the installation. The signal processing method provided by the disclosure solves signal interference and loss problems existed in an antenna of the prior art in a reception mode, through high impedance of the LC resonant circuit to the signal at different frequency bands.

DETAILED DESCRIPTION

The technical solution of the disclosure will further be described in details below with reference to drawings and specific embodiments.

In order to simplify the layout of the PCB and solve the signal interference and loss problems existed in an antenna in a reception mode, a main antenna and an auxiliary antenna of a dual-mode terminal share a same antenna bracket and an LC resonant circuit is disposed ahead of each antenna feeding points, so as to achieve the purpose of the disclosure.

A dual-mode terminal antenna based on the above improvement includes: the main antenna and the auxiliary antenna; the main antenna includes the main antenna of a first mode and the main antenna of a second mode; the auxiliary antenna includes the auxiliary antenna of the first mode and the auxiliary antenna of the second mode; the dual-mode terminal antenna further includes the antenna bracket, wherein the main antennas and the auxiliary antennas are fixed on a same antenna bracket, and the main antennas of the first mode, the auxiliary antennas of the first mode, the main antennas of the second mode, the auxiliary antennas of the second mode is each configured with a spring leaf; wherein when the antenna bracket is clasped on a main board, four spring leaves of the main antennas and the auxiliary antennas contact with four antenna feeding points on the main board respectively.

Figure 2:
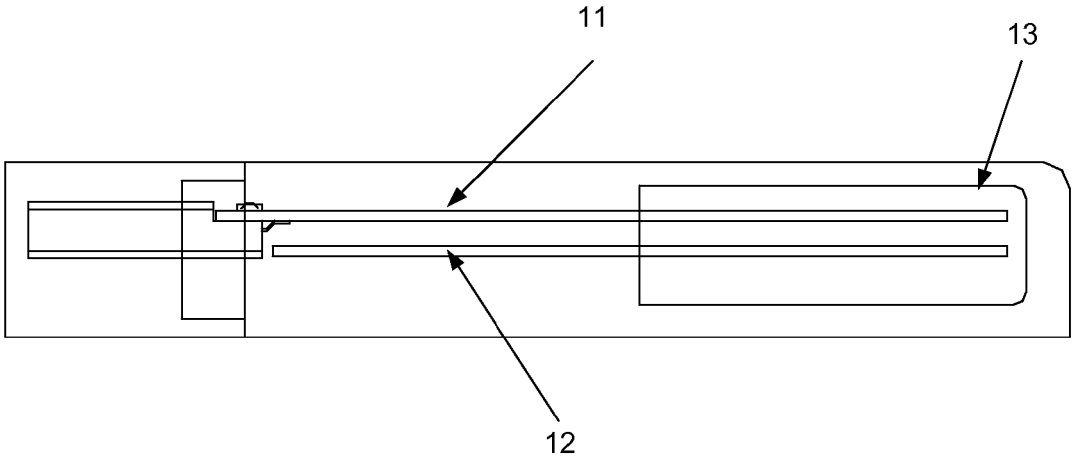
FIG. 2 shows a side view of a dual-mode data card with the WIMAX and EVDO modes in the disclosure.

The dual-mode terminal according to the disclosure is referred to a dual-mode terminal supporting the WIMAX, namely, the dual-mode terminal of the WIMAX and another mode, an example for another mode is the EVDO. The dual-mode terminal with the WINMAX and EVDO modes will be taken as example for description below, wherein the WIMAX represents the above-mentioned first mode and the EVDO represents the above-mentioned second mode. FIG. 2 shows a side view of a dual-mode data card with the WIMAX and EVDO modes; the data card has two layers of main boards, one layer is the WIMAX main board, the other layer is the VDO main board; the main antenna includes the main antenna of the WIMAX and the main antenna of the EVDO, and the auxiliary antenna includes the auxiliary antenna of the WIMAX and the auxiliary antenna of the EVDO; such four antennas are fixed on the same antenna bracket 13, and the four antennas is each configured with a spring leaf; when the antenna bracket is clasped on the main board, the four spring leaves respectively contact with four antenna feeding points on the main board, wherein, the spring leaves of the main antennas and the auxiliary antennas of the WIMAX respectively contact with two antenna feeding points on the WIMAX main board 11, and the spring leaves of the main antennas and the auxiliary antennas of the EVDO respectively contact with two antenna feeding points on the EVDO main board 12.

Figure 1:
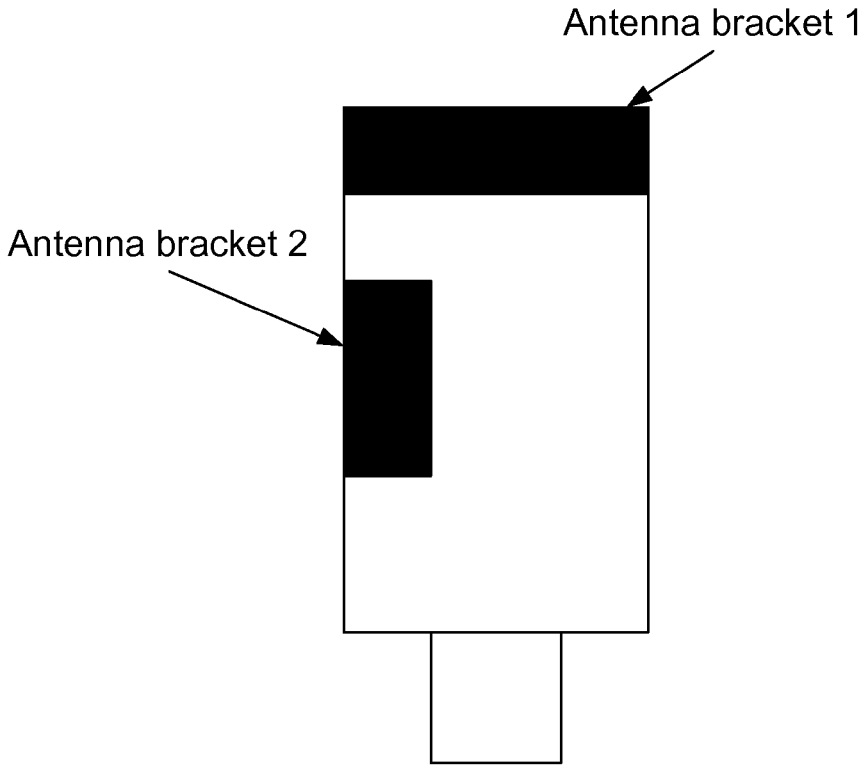
FIG. 1 shows an antenna structure diagram of an existing dual-mode terminal.
Figure 3:
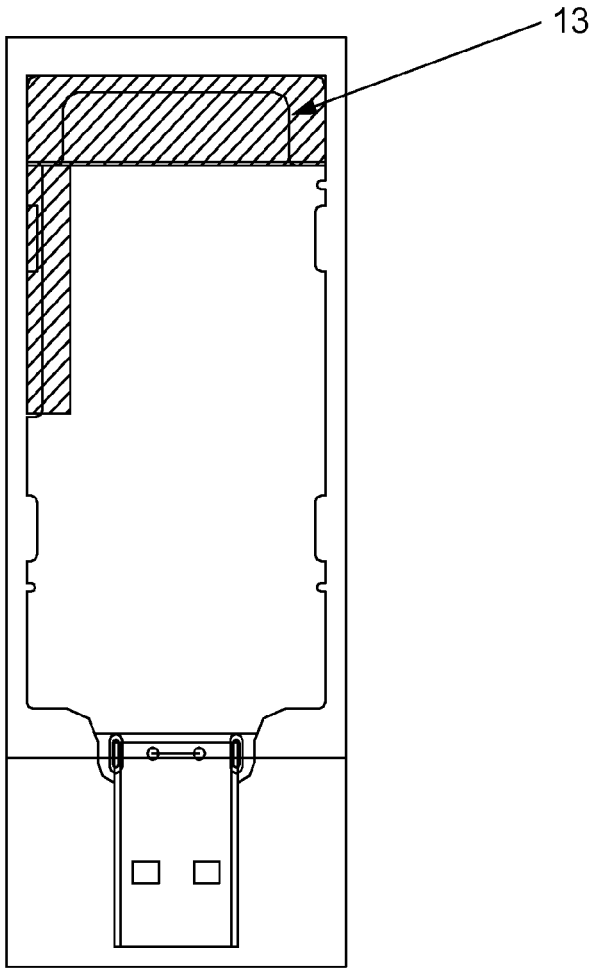
FIG. 3 shows a top view of a dual-mode data card with the WIMAX and EVDO modes in the disclosure.
Figure 4:
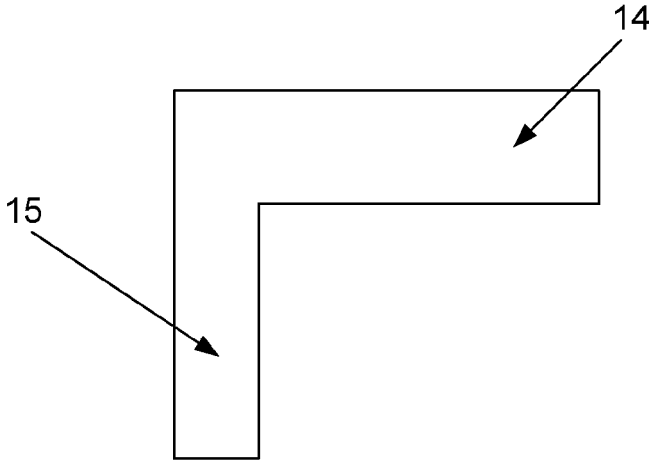
FIG. 4 shows the top view of an antenna bracket in the disclosure.

Preferably, the antenna bracket 13 can be designed to be a right-angle support structure as shown in FIGS. 3 and 4; the shadow part in the FIG. 3 represents antenna bracket 13, and it can thus be seen that a corner of the WIMAX main board 11 and the EVDO main board 12 in FIG. 1 is directly clasped inside the right angle of the antenna bracket 13 shown in FIG. 3. The antenna bracket 13 can be divided into a main antenna area 14 and an auxiliary antenna area 15 as shown in FIG. 4; the main antenna area 14 is used for fixing the main antenna of the WIMAX and the main antenna of the EVDO, the auxiliary antenna area 15 is used for fixing the auxiliary antenna of the WIMAX and the auxiliary antenna of the EVDO. Corresponding, the antenna feeding points on the WIMAX main board 11 and the EVDO main board 12 need to respectively correspond to the main antenna area 14 and the auxiliary antenna area 15 shown in FIG. 4.

Further, in the disclosure, an LC resonant circuit is disposed ahead of each antenna feeding point on the main board, and four said LC resonant circuits respectively resonate at a working frequency band of the antenna corresponding to the antenna feeding point with which each said LC resonant circuit connects, respectively; specifically, the main antenna of the first mode operates at an emission frequency band and a reception frequency band of the first mode, that is, the main antenna of the WIMAX covers the emission frequency band and the reception frequency band of the WIMAX; the auxiliary antenna of the first mode operates at the reception diversity frequency band of the first mode, that is, the auxiliary antenna of the WIMAX covers the reception diversity frequency band of the WIMAX; the main antenna of the second mode operates at the emission frequency band and the reception frequency band of the second mode, that is, the main antenna of the EVDO covers the emission frequency band and the reception frequency band of the EVDO; and the auxiliary antenna of the second mode operates at the reception diversity frequency band of the second mode, that is, the auxiliary antenna of the EVDO covers the reception diversity frequency band of the EVDO. The expression "ahead of an antenna feeding point" means a section of passage from a power output to the antenna feeding point. Correspondingly, the LC resonant circuit disposed ahead of the antenna feeding point, to which the main antenna of the WIMAX connects, resonates at the emission frequency band and reception frequency band of the WIMAX; the LC resonant circuit disposed ahead of the antenna feeding point, to which the auxiliary antenna of the WIMAX connects, resonates at the reception diversity frequency band of the WIMAX; the LC resonant circuit disposed ahead of the antenna feeding point, to which the main antenna of the EVDO connects, resonates at the emission frequency band and the reception frequency band of the EVDO; the LC resonant circuit disposed ahead of the antenna feeding point, to which the auxiliary antenna of the EVDO connects, resonates at the reception diversity frequency band of the EVDO.

The four LC resonant circuits play a role of filtering to solve the signal interference and loss problems existed in an antenna in a reception mode. The signal interference and loss problems existed in an antenna in a reception mode refer to: when the antenna receives a WIMAX signal, a subsequent circuit of the EVDO is equivalent to a 50 ohm matched load of the antenna, so a great part of the WIMAX signal may lose in the subsequent circuit of the EVDO and thus be wasted. Similarly, when the antenna receives an EVDO signal, the subsequent circuit of the WIMAX is also equivalent to the 50 ohm matched load of the antenna, so a great part of the EVDO signal may also lose. These may influence the implementing of the performance of the antenna.

Figure 5:
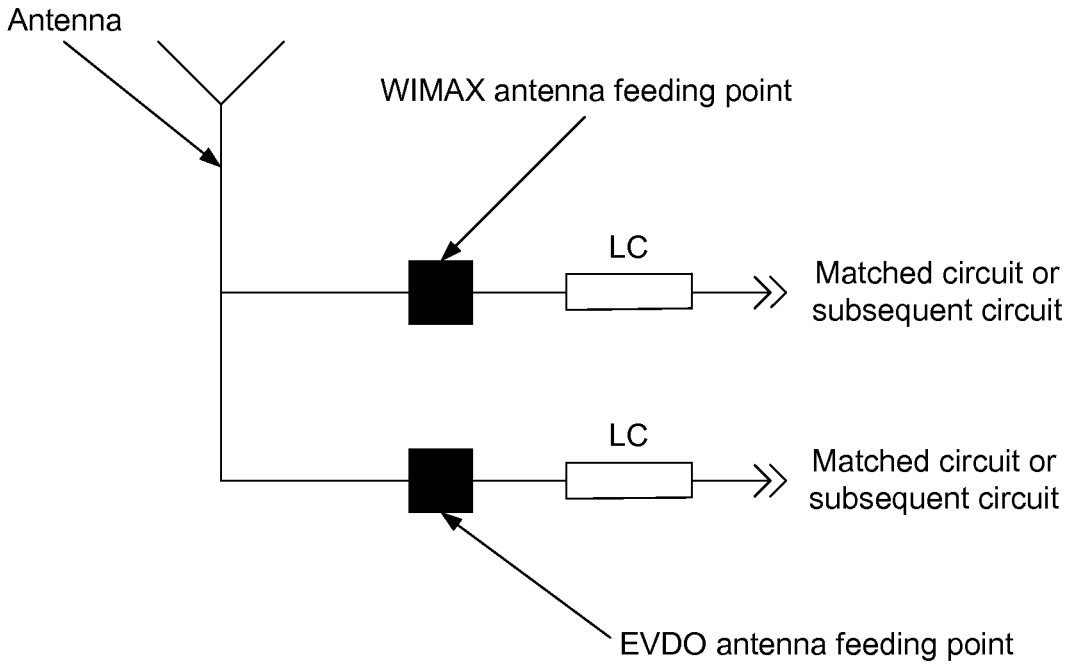
FIG. 5 shows a circuit structure diagram of a dual-mode terminal antenna in the disclosure.

The operating principle of the LC resonant circuit will be described below in conjunction with the circuit structure diagram of the dual-mode terminal antenna shown in FIG. 5. As shown in FIG. 5, an LC resonant circuit, which resonates at the frequency band of the WIMAX, is disposed ahead of a WIMAX antenna feeding point; while an LC resonant circuit, which resonates at the frequency band of the EVDO, is disposed ahead of a EVDO antenna feeding point. When the dual-mode terminal receives the WIMAX signal via the main antenna or the auxiliary antenna of the WIMAX, the LC resonant circuit disposed ahead of the EVDO antenna feeding point creates high impendence to the WIMAX signal, so that an EVDO subsequent circuit is unable to receive the WIMAX signal; when the dual-mode terminal receives the EVDO signal via the main antenna or the auxiliary antenna of the EVDO, the LC resonant circuit disposed ahead of the WIMAX antenna feeding point creates high impendence to the EVDO signals, so that a WIMAX subsequent circuits is unable to receive the EVDO signal. Thus, interference and loss of the WIMAX signal and the EVDO signal are avoided.

Further, the antenna structure of the dual-mode terminal and the corresponding signal processing method according to the disclosure are not limited to the dual-mode terminal with the WIMAX and another mode, which are applicable to the dual-mode terminal of any modes, for example, the dual-mode terminal with LTE and another mode.

The above are only preferred embodiments of the disclosure and are not intended to limit the protection scope of the disclosure.

The invention claimed is:

1. A dual-mode terminal antenna, comprising a main antenna consisting of a main antenna of a first mode and a main antenna of a second mode, and an auxiliary antenna consisting of an auxiliary antenna of the first mode and an auxiliary antenna of the second mode, and the dual-mode terminal antenna further comprising an antenna bracket;

wherein, the main antenna and the auxiliary antenna are fixed on a same said antenna bracket, and the main antenna of the first mode, the auxiliary antenna of the first mode, the main antenna of the second mode and the auxiliary antenna of the second mode are each configured with a spring leaf;

wherein, when the antenna bracket is clasped on a main board, four spring leaves of the main and auxiliary antennas contact with four antenna feeding points on the main board respectively; and wherein, an LC resonant circuit is disposed ahead of each said antenna feeding point, and four LC resonant circuits respectively resonate at a working frequency band of the antenna corresponding to the antenna feeding point with which each said LC resonant circuit connects, wherein, when the dual-mode terminal receives a signal of the first mode via the main antenna or the auxiliary antenna of the first mode, the LC resonant circuit disposed ahead of the antenna feeding point of the second mode creates high impendence to the signal of the first mode, so that a subsequent circuit of the second mode is unable to receive the signal of the first mode, wherein, when the dual-mode terminal receives a signal of the second mode via the main antenna or the auxiliary antenna of the second mode, the LC resonant circuit disposed ahead of the antenna feeding point of the first mode creates high impendence to the signal of the second mode, so that a subsequent circuit of the first mode is unable to receive the signal of the second mode, thus avoiding interference and loss of the signal of the first mode and the signal of the second mode.

2. The dual-mode terminal antenna according to claim 1, wherein the antenna bracket is a right-angle bracket.

3. The dual-mode terminal antenna according to claim 1, wherein the antenna bracket has a main antenna area and an auxiliary antenna area, which are used for fixing the main antenna and the auxiliary antenna respectively.

4. The dual-mode terminal antenna according to claim 1, wherein the main antenna of the first mode operates at an emission frequency band and a reception frequency band of the first mode, the auxiliary antenna of the first mode operates at a reception diversity frequency band of the first mode, the main antenna of the second mode operates at the emission frequency band and the reception frequency band of the second mode, and the auxiliary antenna of the second mode operates at the reception diversity frequency band of the second mode.

5. The dual-mode terminal antenna according to claim 1, wherein the first mode is a Worldwide Interoperability for Microwave Access (WIMAX) and the second mode is an Evolution Data Only (EVDO).

6. The dual-mode terminal antenna according to claim 2, wherein the main antenna of the first mode operates at an emission frequency band and a reception frequency band of the first mode, the auxiliary antenna of the first mode operates at a reception diversity frequency band of the first mode, the main antenna of the second mode operates at the emission frequency band and the reception frequency band of the second mode, and the auxiliary antenna of the second mode operates at the reception diversity frequency band of the second mode.

7. The dual-mode terminal antenna according to claim 3, wherein the main antenna of the first mode operates at an emission frequency band and a reception frequency band of the first mode, the auxiliary antenna of the first mode operates at a reception diversity frequency band of the first mode, the main antenna of the second mode operates at the emission frequency band and the reception frequency band of the second mode, and the auxiliary antenna of the second mode operates at the reception diversity frequency band of the second mode.

8. The dual-mode terminal antenna according to claim 2, wherein the first mode is a Worldwide Interoperability for Microwave Access (WIMAX), and the second mode is an Evolution Data Only (EVDO).

9. The dual-mode terminal antenna according to claim 3, wherein the first mode is a Worldwide Interoperability for Microwave Access (WIMAX), and the second mode is an Evolution Data Only (EVDO).

10. A signal processing method, comprising:

resonating, by a LC resonant circuit disposed ahead of each antenna feeding point of a dual-mode terminal antenna, at a working frequency band of the antenna corresponding to the antenna feeding point with which each said LC resonant circuit connects, respectively;

when the dual-mode terminal antenna receives a signal of a first mode, creating high impendence, by the LC resonant circuit disposed ahead of the antenna feeding point of a second mode, to the signal of the first mode, so that a subsequent circuit of the second mode is unable to receive the signal of the first mode; and when the dual-mode terminal antenna receives a signal of the second mode, creating high impendence, by the LC resonant circuit disposed ahead of the antenna feeding point of the first mode, to the signal of the second mode, so that a subsequent circuit of the first mode is unable to receive the signal of the second mode, thus avoiding interference and loss of the signal of the first mode and the signal of the second mode, wherein the dual-mode terminal antenna comprises:

a main antenna consisting of a main antenna of a first mode and a main antenna of a second mode; an auxiliary antenna consisting of an auxiliary antenna of the first mode and an auxiliary antenna of the second mode; and an antenna bracket for fixing the main antenna and the auxiliary antenna;

wherein the main antenna of the first mode, the auxiliary antenna of the first mode, the main antenna of the second mode and the auxiliary antenna of the second mode are each configured with a spring leaf; when the antenna bracket is clasped on a main board, four spring leaves of the main and auxiliary antennas contact with four antenna feeding points on the main board respectively.

11. The signal processing method according to claim 10, further comprising: receiving, by the dual-mode terminal antenna, the signal of the first mode via the main and auxiliary antennas of the first mode, and receiving the signal of the second mode via the main and auxiliary antennas of the second mode.

12. The signal processing method according to claim 11, wherein the main antenna of the first mode operates at an emission frequency band and a reception frequency band of the first mode, the auxiliary antenna of the first mode operates at a reception diversity frequency band of the first mode, the main antenna of the second mode operates at the emission frequency band and the reception frequency band of the second mode, and the auxiliary antenna of the second mode operates at the reception diversity frequency band of the second mode.

13. The signal processing method according to claim 10, wherein the first mode is a Worldwide Interoperability for Microwave Access (WIMAX), and the second mode is an Evolution Data Only (EVDO).

14. The signal processing method according to claim 11, wherein the first mode is a Worldwide Interoperability for Microwave Access (WIMAX), and the second mode is an Evolution Data Only (EVDO).

15. The signal processing method according to claim 12, wherein the first mode is a Worldwide Interoperability for Microwave Access (WIMAX), and the second mode is an Evolution Data Only (EVDO).

* * * * *